US006419467B1

(12) United States Patent
Murase et al.

(10) Patent No.: US 6,419,467 B1
(45) Date of Patent: Jul. 16, 2002

(54) STRUCTURE FOR SUCTION VALVE OF PISTON TYPE COMPRESSOR

(75) Inventors: Muneharu Murase; Atsuyuki Morishita; Masakazu Murase; Katsuya Ohyama; Masahiro Kawaguchi, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/572,678

(22) Filed: May 16, 2000

(30) Foreign Application Priority Data

May 19, 1999 (JP) ..... 11-138674

(51) Int. Cl.[7] ..... F04B 49/00; F04B 39/10; F04B 53/10; F16K 15/16

(52) U.S. Cl. ..... 417/504; 417/571; 417/560; 137/855

(58) Field of Search ..... 417/504, 571, 417/560; 137/855, 856, 857, 858

(56) References Cited

U.S. PATENT DOCUMENTS 2,725,183 A * 11/1955 Hanson ..... 230/231
3,200,838 A * 8/1965 Sheaffer ..... 137/512.15
3,905,391 A * 9/1975 Oakes ..... 137/525.3
4,098,296 A * 7/1978 Grasso et al. ..... 137/855
5,078,582 A * 1/1992 Ohbayashi et al. ..... 417/571
5,213,488 A * 5/1993 Takahashi ..... 417/569
5,421,368 A * 6/1995 Maalouf et al. ..... 137/856
5,674,054 A 10/1997 Ota et al. ..... 417/269
5,857,839 A * 1/1999 Fisher et al. ..... 417/269
5,871,337 A * 2/1999 Fukanuma et al. ..... 417/222.2

FOREIGN PATENT DOCUMENTS

JP P 2-161182 6/1990
JP P 9-273478 10/1997
WO 97-27402 * 7/1997 ..... F04B/39/00

* cited by examiner

*Primary Examiner*—Michael Koczo
*Assistant Examiner*—Timothy P. Solak
(74) *Attorney, Agent, or Firm*—Woodcock Washburn LLP

(57) ABSTRACT

In the suction valve structure of the piston type compressor of the present invention, the primary suction valve 38 is a flexible deforming valve composed of a deforming section 381, which is supported and bent by a cantilever method, and a closing section 382 which connects with a forward end of the deforming section 381 and closes the primary suction port 21. The auxiliary suction valve 39 is a flexible deforming valve composed of a deforming section 391, which is supported-and bent by a cantilever method, and a closing section 392 which connects with a forward end of the deforming section 391 and closes the auxiliary suction port 22. In the present invention, the length of the deforming section 381 of the primary suction valve 38 is approximately the same as that of the deforming section 391 of the auxiliary suction valve 39, however, the width of the deforming section 381 of the primary suction valve 38 is made larger than that of the deforming section 391 of the auxiliary suction valve 39.

8 Claims, 6 Drawing Sheets

STRUCTURE FOR SUCTION VALVE OF PISTON TYPE COMPRESSOR

BACKGROUND OF THE INVENTION

1. Field of the Invention

The present invention relates to a structure of a suction valve of a piston type compressor in which a suction port for sucking refrigerant gas is opened and closed by the suction valve, and the refrigerant gas is sucked into a cylinder bore by the suction valve which is pulled apart from the suction port by a sucking motion of a piston arranged in a cylinder bore.

2. Description of the Related Art

In the case of a piston type compressor disclosed in Japanese Unexamined Patent Publication No. 9-273478, while a suction valve is being moved from a closing position to the maximum open position, at which the degree of opening becomes maximum, vibration of the suction valve is caused, and sucking pulsations are caused by this vibration of the suction valve. These sucking pulsations vibrate an evaporator incorporated into an external refrigerant circuit and generate noise. In Japanese Unexamined Patent Publication No. 2-161182, there is disclosed a suction valve structure for preventing the occurrence of vibration of the suction valve. In this conventional device, two suction ports are arranged for one cylinder bore, one is a primary suction port, and the other is an auxiliary suction port. The primary suction port is opened and closed by a primary suction valve, and the auxiliary suction port is opened and closed by an auxiliary suction valve. When the piston starts its sucking motion, first, the auxiliary suction valve starts moving from a position at which the auxiliary suction port is closed by the auxiliary suction valve to a position at which the auxiliary suction valve comes into contact with an engaging recess so that the maximum degree of opening can be determined. Next, the primary suction valve starts moving from a position at which the primary suction port is closed by the primary suction valve to a position at which the primary suction valve comes into contact with an engaging recess so that the maximum degree of opening can be determined. The auxiliary suction valve is moved to the position at which the maximum degree of opening of the auxiliary valve can be obtained before the primary suction valve is moved to the position at which the maximum degree of opening of the primary valve can be obtained. Since the auxiliary suction valve is integrally formed on the primary valve in an opposite direction, when the auxiliary suction valve comes into contact with the engaging recess, the occurrence of the vibration of the entire suction valve can be suppressed.

However, according to the structure in which the auxiliary suction valve is integrally arranged in the opposite direction on the primary suction valve which is moved in the same manner as that of the auxiliary suction valve, it becomes difficult to set a degree of the easiness of opening the auxiliary and the primary suction valve. Both the auxiliary and the primary suction valve are flexible valves, in which deflection is caused in such a manner that the closer to the forward end portions, the more deflection is caused in the valves.

However, in the above structure, there is a restriction that the length of the auxiliary suction valve arranged on the primary suction valve, that is, the distance from the root of the auxiliary valve to the auxiliary suction port is approximately half of the distance from the primary suction port to the auxiliary suction port. Due to the above restriction, it becomes difficult to easily open the auxiliary suction valve, and further it becomes difficult to ensure the maximum degree of opening of the valve within the limit of elasticity. When it is difficult to open the auxiliary suction valve, it becomes difficult to suppress the occurrence of self-excited vibration.

SUMMARY OF THE INVENTION

It is an object of the present invention to provide a structure of a suction valve of a piston type compressor effective for preventing the occurrence of abnormal sounds caused by vibration of the suction valve.

In order to accomplish the above object, the present invention provides a structure of a suction valve of a piston type compressor in which a suction port for sucking refrigerant gas is opened and closed by the suction valve, and the refrigerant gas is sucked into a cylinder bore by the suction valve which is pulled apart from the suction port by a sucking motion of a piston arranged in a cylinder bore, the structure of the suction valve comprising: a plurality of suction ports corresponding to one cylinder bore; a plurality of suction valves corresponding to each suction port, respectively; a plurality of maximum opening degree restricting means for restricting the maximum opening degree of each suction valve when the maximum opening degree restricting means comes into contact with each suction valve, corresponding to each suction valve, respectively; and a plurality of opening performance restricting means for restricting the opening performance of the suction valves to open the suction ports, corresponding to each suction port, respectively, wherein the opening and closing motions of the plurality of suction valves are made independent from each other, and the opening performance of at least one of the plurality of suction valves is enhanced more than the opening performance of at least one of the other suction valves.

In a state in which a rate of flow is low, that is, in a state in which a rotating speed of a compressor is low or alternatively a variable capacity type compressor is operated in a small capacity condition, only a suction valve, the opening performance of which is high, opens a suction port, and the opening performance is set so that this suction valve can be immediately transferred to the maximum opening degree position at which the suction valve comes into contact with the maximum opening degree restricting means. When the opening performance is set as described above, in a suction stroke of the piston in the state in which the rate of flow is low, only the suction valve, the opening performance of which is high, opens the suction port, and this suction valve can be immediately transferred to the maximum opening degree position. The above structure, in which the suction valve, the opening performance of which is high when a rate of flow is low, is immediately transferred to the maximum opening degree position when the sucking motion is started, is effective for suppressing the occurrence of vibration of the suction valve.

The present invention may be more fully understood from the description of a preferred embodiment set forth below, together with the accompanying drawings.

DESCRIPTION OF THE PREFERRED EMBODIMENTS

Referring to FIGS. 1 to 4, the first embodiment of the present invention, in which the present invention is applied to a variable capacity type compressor, will be explained below.

Figure 1:
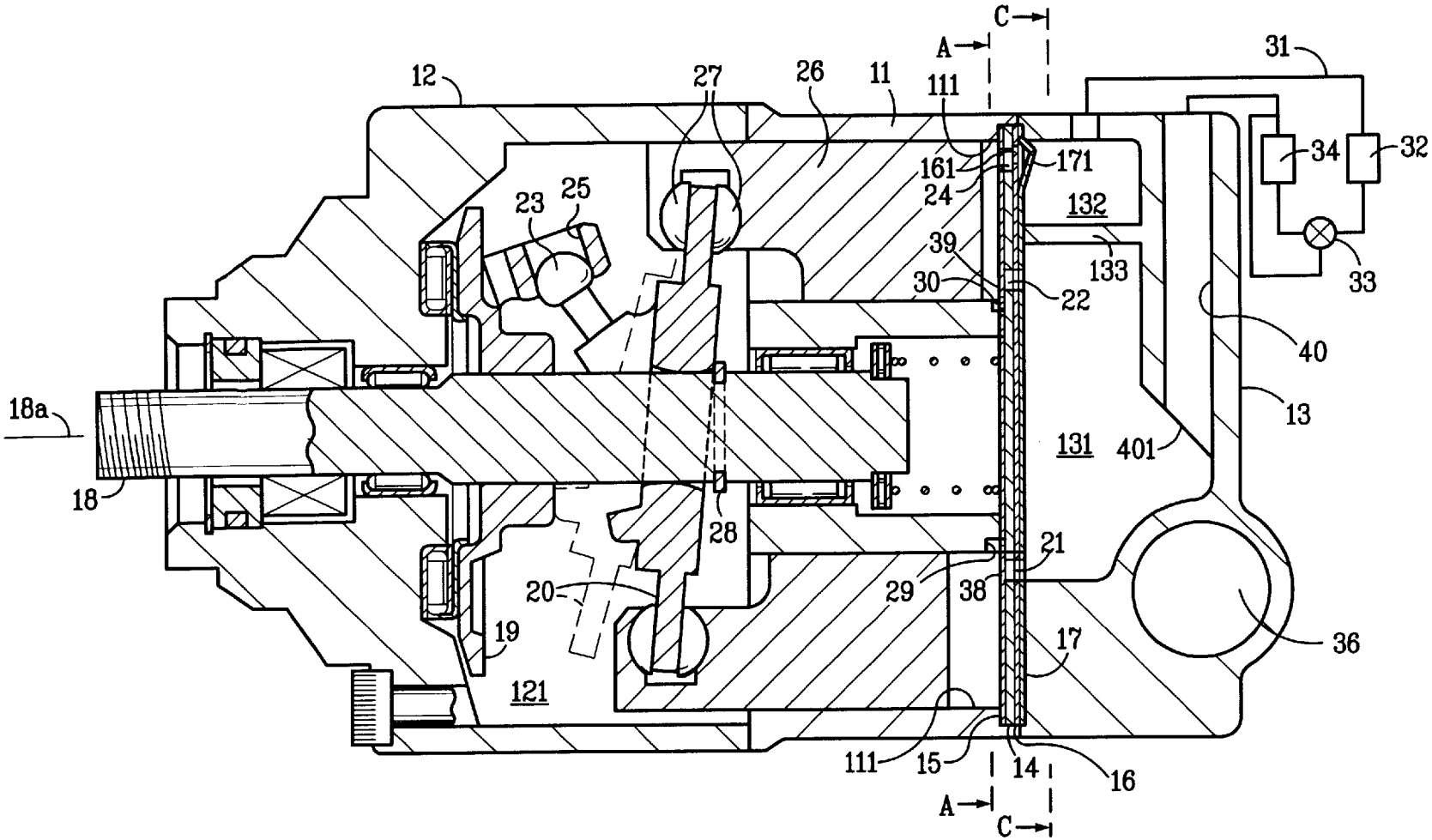
FIG. 1 is a cross-sectional side view showing an overall compressor of the first embodiment of the present invention.

As shown in FIG. 1, there is provided a cylinder block 11, to the forward end portion of which a front housing 12 is joined. There is provided a rear housing 13 which is joined to the rear end portion of the cylinder block 11 via a partition plate 14, valve forming plates 15, 16, and retainer forming plate 17. A rotating shaft 18 having a shaft axis 18*a* is supported by the front housing 12 and the cylinder block 11 forming a control pressure chamber 121. The rotating shaft 18 protrudes from the control pressure chamber 121, and this rotating shaft 18 is given a drive force from an external drive force source such as an automobile engine (not shown) via a pulley (not shown) and a belt (not shown).

A rotational support body 19 is fixed to the rotating shaft 18. A swash plate 20 is supported by the rotating shaft 18 in such a manner that the swash plate 20 can slide in the axial direction of the rotating shaft 18 and tilted with respect to the rotating shaft 18. The swash plate 20 can be tilted in the axial direction of the rotating shaft 18 and rotated integrally with the rotating shaft 18 by the cooperation of a guide pin 23 attached to the swash plate 20 with a guide hole 25 formed on the rotational support 19. The swash plate 20 can be tilted by the relation of sliding guide between the guide hole 25 and the guide pin 23 and guided by the sliding support action of the rotating shaft 18. The guide pin 23 and guide hole 25 compose a hinge mechanism for tilting the swash plate 20.

When the radial center of the swash plate 20 is moved to the side of the rotational support body 19, the tilt angle of the swash plate 20 is increased. When the radial center of the swash plate 20 is moved onto the side of the cylinder block 11, the tilt angle of the swash plate 20 is decreased. The minimum tilt angle of the swash plate 20 is restricted by the contact of the snap ring 28 attached to the rotating shaft 18 with the swash plate 20. The maximum tilt angle of the swash plate 20 is restricted by the contact of the rotational support body 19 with the swash plate 20. The solid line of the swash plate 20 in FIG. 1 shows the minimum tilt angle position of the swash plate 20, and the chain line of the swash plate 20 in FIG. 1 shows the maximum tilt angle position of the swash plate 20.

Figure 2:
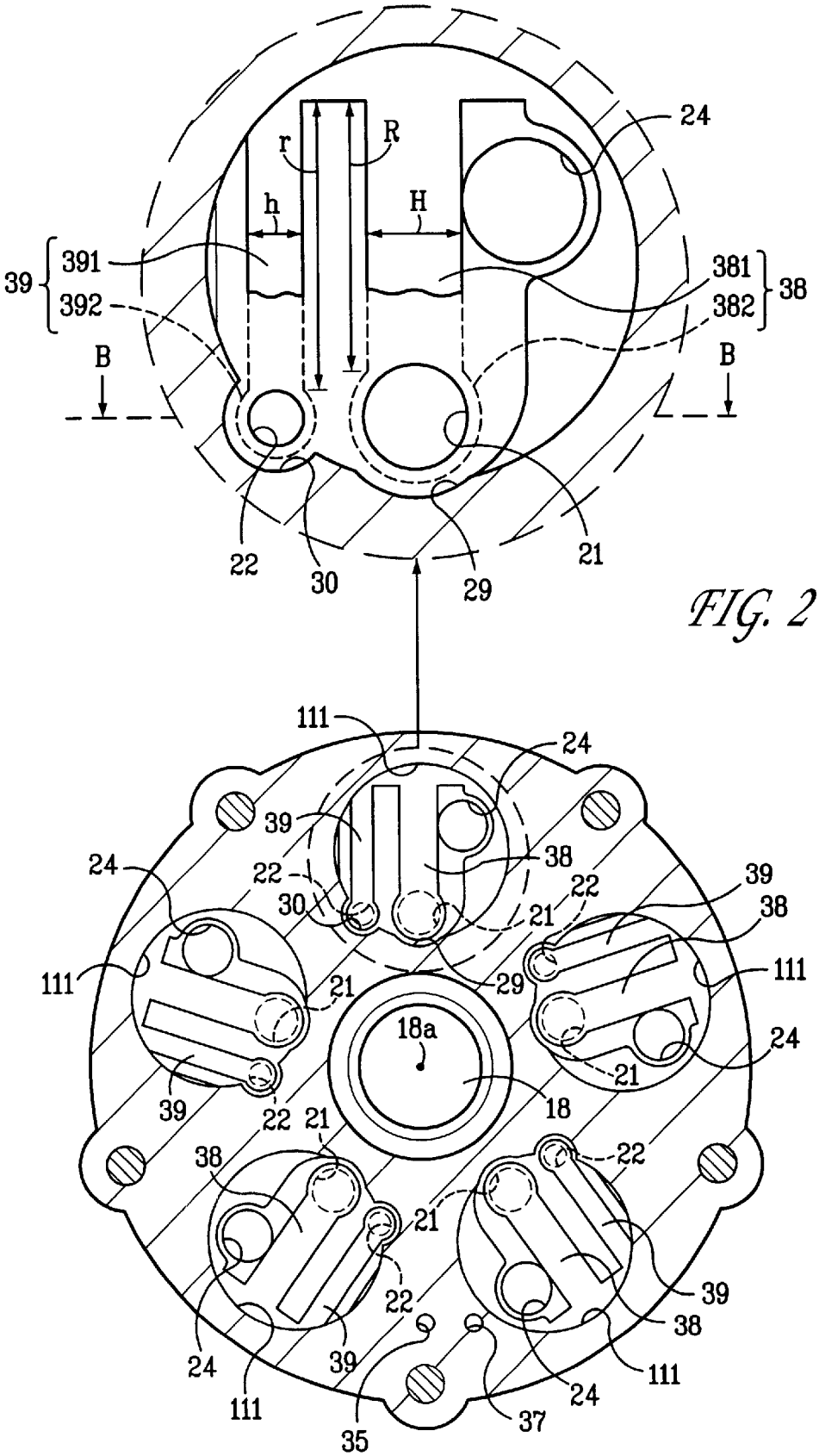
FIG. 2 is a cross-sectional view taken on line A—A in FIG. 1.

As shown in FIG. 2, a plurality of bores 111 are formed in the cylinder block 11. In this example, five bores 111 are formed. The plurality of bores 111 are arranged round the rotational shaft axis 18*a* of the rotating shaft 18 at regular intervals. A piston 26 is accommodated in each cylinder 111. The rotational motion of the swash plate 20 is converted into the reciprocating motion of each piston 26 via a shoe 27. Therefore, each piston is reciprocated in the cylinder bore 111 in the longitudinal direction.

Figure 3:
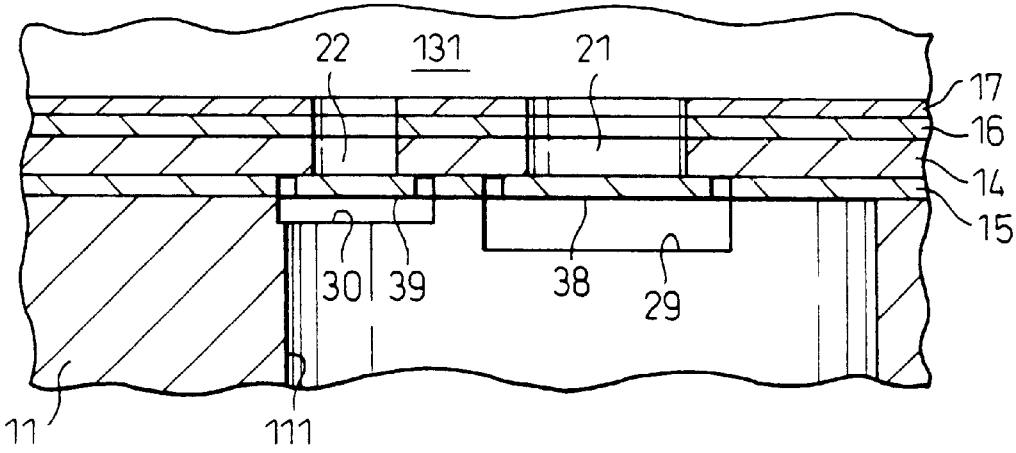
FIG. 3 is a cross-sectional view taken on line B—B in FIG. 2.
Figure 4:
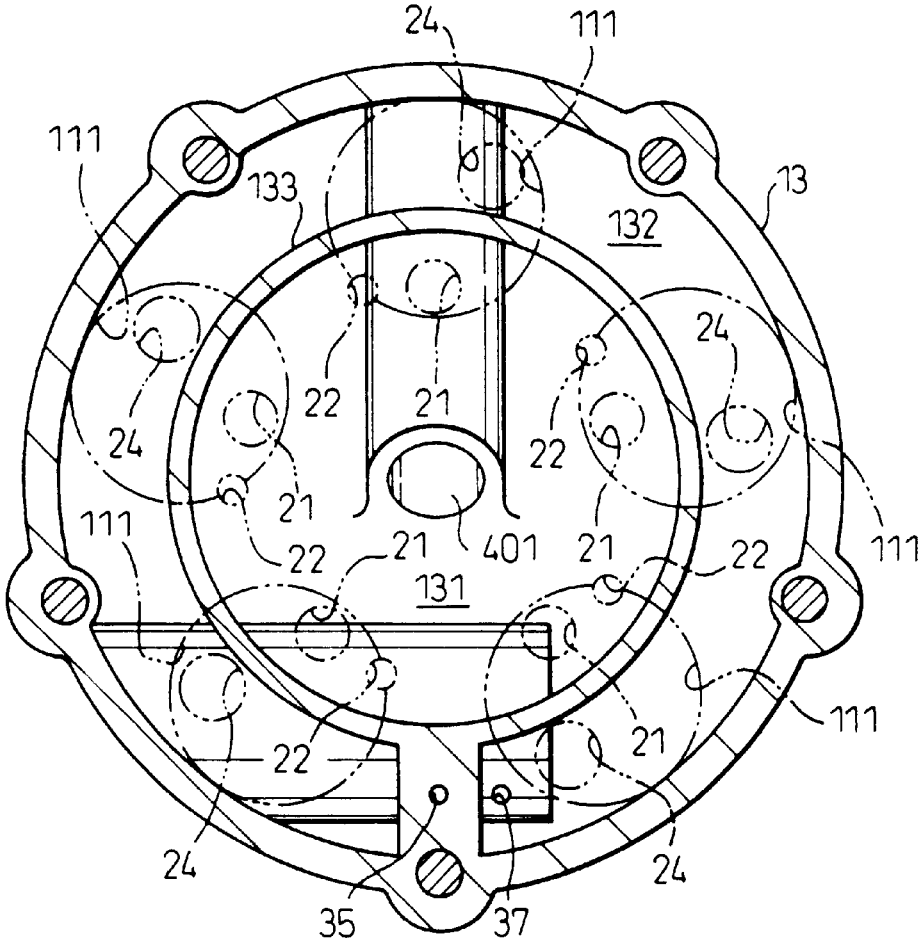
FIG. 4 is an enlarged cross-sectional view taken on line C—C in FIG. 1.

As shown in FIGS. 1 and 4, there are formed a suction chamber 131 and discharge chamber 132 in the rear housing 13. The discharge chamber 132 surrounds the side of the suction chamber 131 via a bulkhead 133. On the rear wall of the rear housing 13, there is provided a supply passage 40. The supply passage 40 crosses the discharge chamber 132 from the circumferential wall of the rear housing 13 and communicates with the suction chamber 131. There are provided a primary suction port 21 and auxiliary suction port 22 corresponding to each cylinder bore 111 on the partition plate 14, valve forming plate 16 and retainer forming plate 17. There is provided a discharge port 24 corresponding to each cylinder bore 111 on the partition plate 14 and the valve forming plate 15. On the valve forming plate 15, there are provided a primary suction valve 38 and auxiliary suction valve 39. On the valve forming plate 16, there is provided a discharge valve 161. The primary suction valve 38 opens and closes the primary suction port 21, and the auxiliary suction valve 39 opens and closes the auxiliary suction port 22. The discharge valve 161 opens and closes the discharge port 24. As shown in FIG. 3, the maximum opening degree restricting recesses 29, 30 are formed in each cylinder bore 111. The maximum opening degree restricting recess 29 restricts the maximum opening degree of the primary suction valve 38, and the maximum opening degree restricting recess 30 restricts the maximum opening degree of the auxiliary suction valve 39. The depth of the maximum opening degree restricting recess 29 is larger than the depth of the maximum opening degree restricting recess 30. The maximum opening degree of the primary suction valve 38 is larger than the maximum opening degree of the auxiliary suction valve 39.

When the piston 26 conducts discharging operation, refrigerant gas is discharged from the cylinder bore 111 into the discharge chamber 132 via the discharge port 24 while the refrigerant gas is putting away the discharge valve 161 by its pressure. The opening degree of the discharge valve 161 is restricted in such a manner that the discharge valve 161 comes into contact with the retainer 171 arranged on the retainer forming plate 17.

After the refrigerant has been discharged into the discharge chamber 132, it is returned from the supply passage 40 into the suction chamber 131 via the condenser 32, expansion valve 33 and evaporator 34 incorporated into the external refrigerant circuit 31 arranged outside the compressor.

On the pressure supply passage 35 (shown in FIG. 2) connecting the discharge chamber 132 with the control pressure chamber 121, there is provided an electromagnetic type capacity control valve 36. The refrigerant is supplied from the discharge chamber 132 into the control pressure chamber 121 via the pressure supply passage 35. A controller (not shown in the drawing) conducts magnetizing and demagnetizing control on the electromagnetic type capacity control valve 36. Therefore, magnetization and demagnetization of the electromagnetic type capacity control valve 36 are controlled by the controller according to the passenger compartment temperature detected by a passenger compartment temperature detector (not shown) for detecting the passenger compartment temperature of an automobile and also according to a target passenger compartment temperature that has been set by a passenger compartment temperature setting device (not shown).

The refrigerant gas flows from the control pressure chamber 121 into the suction chamber 131 via a pressure releasing passage 37 (shown in FIG. 2). When the electromagnetic type capacity control valve 36 is demagnetized, no refrigerant gas is sent from the discharge chamber 132 to the control pressure chamber 121. Accordingly, a difference in the control pressure in the control pressure chamber 121 and the suction pressure via the piston 15 is decreased. Therefore, the swash plate 14 is transferred onto the maximum tilting angle side. When the electromagnetic type capacity control valve 36 is magnetized, refrigerant gas is sent from the discharge chamber 132 into the control pressure chamber 121 via the pressure supply passage 35. Accordingly, a difference between the control pressure in the control pressure chamber 121 and the suction pressure via the piston 15 is increased. Therefore, the swash plate 14 is transferred onto the minimum tilting angle side.

As shown in FIGS. 2 and 3, the profiles of the primary suction port 21 and the auxiliary suction port 22 are circular, and the diameter of the primary suction port 21 is larger than that of the auxiliary suction port 22. The primary suction valve 38 is a flexible deforming valve including a deforming section 381, which is supported by a cantilever method, and a closing section 382, for closing the primary suction port 21, connected with a forward end portion of the deforming section 381. The auxiliary suction valve 39 is a flexible deforming valve including a deforming section 391, which is supported by a cantilever method, and a closing section 392, for closing the auxiliary suction port 22, connected with a forward end portion of the deforming section 391. Length R of the deforming section 381 of the primary suction valve 38 is approximately the same as length r of the deforming section 391 of the auxiliary suction valve 39. However, width H of the deforming section 381 of the primary suction valve 38 is larger than width h of the deforming section 391 of the auxiliary suction valve 39. The primary suction valve 38 and the auxiliary suction valve 39 extend from the discharge chamber 132 side to the suction chamber 131 side in such a manner that they cross the cylinder bore 111 in the radial direction of the rotating shaft 18 when a view is taken in the axial direction of the rotating shaft 18.

When the swash plate 20 is set at a position lose to the minimum tilting angle, a stroke of the piston 26 is short, and the discharging capacity is small. In the above condition in which the rate of flow is low, the refrigerant gas flows from the suction chamber 131 into the cylinder bore 111 via the auxiliary Suction port 22 by the sucking motion of the piston 26 while the refrigerant gas is pushing up the auxiliary suction valve 39 by its pressure, however, the primary suction valve 38 is kept closing the primary suction port 21. When the tilting angle of the swash plate 20 is increased as compared with a state shown in FIG. 1, the stroke of the piston 26 is increased, and the discharging capacity is increased. When the discharging capacity is increased to a predetermined value, the refrigerant gas also flows from the suction chamber 131 into the cylinder bore 111 via the primary suction port 21 by the suing motion of the piston 26 while the refrigerant gas is pushing up the primary suction valve 38 by its pressures.

It is possible for the first embodiment to provide the following effects.

Length R of the deforming section 381 of the primary suction valve 38 is approximately the same as length r of the deforming section 391 of the auxiliary suction valve 39. However, width H of the deforming section 381 of the primary suction valve 38 is larger than width h of the deforming section 391 of the auxiliary suction valve 39. The thicknesses of the primary suction valve 38 and that of the auxiliary suction valve 39, which are integrally formed on the valve forming plate 15, are the same. Therefore, the auxiliary suction valve 39 can be more easily opened than the primary suction valve 38, that is, the opening performance of the deforming section 391 is higher than the opening performance of the deforming section 381. Consequently, in the case of a low capacity, only the auxiliary suction port 22 is opened. After the auxiliary suction valve 39 has opened the auxiliary suction port 22, it is immediately transferred to the maximum opening degree position at which the auxiliary suction valve 39 comes into contact with the maximum opening degree restricting recess 30. Therefore, vibration of the auxiliary valve 39 seldom occurs. When the discharging capacity is increased, the primary suction valve 38 also opens the primary suction port 21. When the discharging capacity is increased, a rate of flow of refrigerant gas flowing from the suction chamber 131 into the cylinder bore 111 is increased. When the rate of flow of refrigerant gas flowing from the suction chamber 131 into the cylinder bore 111 is increased, sucking pulsations caused by the vibration of the primary suction valve 38 are prevented from being transmitted to the evaporator 34. That is, in order to prevent the occurrence of a bad influence caused by the vibration of the suction valves, it is sufficient that the vibration is prevented only when the refrigerant flows at a low rate of flow.

In this embodiment, the opening performance is set as follows. When the refrigerant gas flows at a low rate of flow, only the auxiliary suction valve 39, the opening performance of which is high, opens the auxiliary suction port 22 and is immediately transferred to the maximum opening degree position at which the auxiliary suction valve 39 comes into contact with the maximum opening restricting recess 30. Accordingly, in a suction stroke of the piston 26 when the refrigerant gas flows at a low rate of flow, only the auxiliary suction valve 39, the opening performance of which is higher than the opening performance of the primary suction valve 38, opens the auxiliary suction port 22 and is immediately transferred to the maximum opening degree position. When this arrangement is adopted in which the auxiliary suction valve 39 of high opening performance is immediately transferred to the maximum opening degree position when the refrigerant flows at a low rate of flow, the occurrence of vibration of the suction valve can be effectively suppressed.

The structure of a pair of flexible deforming valves 38, 39 integrally formed on the valve forming plate 15 is simple as a suction valve. The deforming section 381 of the primary suction valve 38 is a pushing means for pushing the primary suction valve 38 so that the primary suction port 21 can be closed. The deforming section 391 of the auxiliary suction valve 39 is a pushing means for pushing the auxiliary suction valve 39 so that the auxiliary suction valve 39 can be closed. Concerning the pushing means, the lower the intensity of the pushing force is, the higher the opening performance is enhanced. However, when length R of the deforming section 381 is the same as length r of the deforming section 391, the intensity of the pushing force is determined by a difference between width H of the deforming section 381 and width h of the deforming section 391. Width H of the deforming section 381 and width h of the deforming section 391 are simple factors for appropriately setting the opening performance.

Diameter D of the primary suction port 21 is larger than diameter d of the auxiliary suction port 22, and the cross-sectional area of the primary suction port 21 is larger than the cross-sectional area of the auxiliary suction port 22. The pressure acting on the closing section 382 of the primary suction valve 38 from the suction chamber side 131 is higher than the pressure acting on the closing section 392 of the auxiliary suction valve 39 from the suction chamber side 131. When diameter D of the primary suction port 21 and diameter d of the auxiliary suction port 22 are changed, the pressure is also changed. The cross-sectional areas of the primary suction port 21 and the auxiliary suction port 22 are, respectively, the opening performance restricting means for restricting the opening performance of the primary suction valve 38 and the auxiliary suction valve 39. When the width H of the deforming section 381 and the width h of the deforming section 391, and the diameter D of the primary suction port 21 and the diameter d of the auxiliary suction port 22, are appropriately combined and selected, it becomes possible to conduct setting the opening performance of the primary suction valve 38 and the opening performance of the auxiliary suction valve 39.

Since the circumference of the suction chamber 131 is surrounded by the discharge chamber 132, the suction chamber, the profile of which is columnar, can be formed. When the circumference of the discharge chamber is surrounded by the suction chamber, the profile of the suction chamber becomes annular. The suction chamber 131 is provided for suppressing the occurrence of sucking pulsation. The columnar suction chamber 131 is superior to the annular suction chamber in suppressing the occurrence of sucking pulsation. Since the outlet 401 of the supply passage 40 is located at a substantially equal distance from the primary suction port 21 and the auxiliary suction port 22, pressure fluctuation at the outlet 401 can be minimized. In Japanese Unexamined Patent Publication No. 64-56583, there is a description of a position in the discharge chamber at which pressure fluctuation of the discharging pulsation can be minimized. The same can be said with respect to the sucking pulsation. Pressure fluctuation of the sucking pressure at the outlet 401 is transmitted from the supply passage 40 to the external refrigerating circuit 31 as sucking pulsation, and the evaporator 34 arranged in the passenger compartment of an automobile is vibrated by the action of sucking pulsation caused by the resonance frequency. However, since the sucking pulsation is minimized, an intensity of noise caused by the vibration of the evaporator 34 is low.

The primary suction valve 38 and the auxiliary suction valve 39 extend from the discharge chamber 132 side to the suction chamber 131 side in such a manner that they cross the cylinder bore 111 in the radial direction of the rotating shaft 18 when a view is taken in the axial direction of the rotating shaft 18. Therefore, the deforming sections 381, 391 can be set at a length close to the diameter of the cylinder bore 111. That is, the degree of freedom of setting the lengths of the deforming sections 381, 391 is high, and the degree of freedom of setting the maximum opening degree of the primary suction valve 38 and the auxiliary suction valve 39 is high when consideration is given to the elastic limit of material of the primary suction valve 38 and the auxiliary suction valve 39. The maximum opening degrees of the primary suction valve 38 and the auxiliary suction valve 39 have influence on the pressure loss of suction, that is, the lower the pressure loss of suction is, the higher the volumetric efficiency is increased. Due to the high degree of freedom of setting the maximum opening degrees of the primary suction valve 38 and the auxiliary suction valve 39, the maximum opening degrees of the primary suction valve 38 and the auxiliary suction valve 39 can be easily set while consideration is given to the volumetric efficiency.

Figure 5:
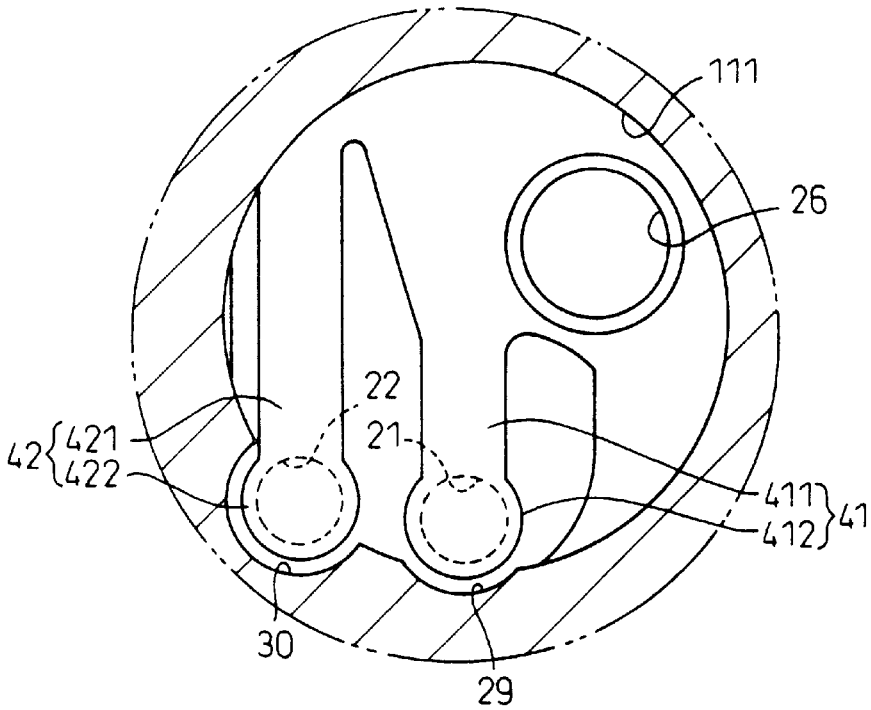
FIG. 5 is an enlarged cross-sectional view showing a primary portion of the second embodiment of the present invention.

Next, referring to FIG. 5, the second embodiment will be explained as follows. Like reference characters are used to indicate like parts in the first and the second embodiment.

The diameter of the primary suction port 21 and that of the auxiliary suction port 22 are the same. Therefore, the cross-sectional area of the primary suction port 21 and that of the auxiliary suction port 22 are the same. The width of the deforming section 411 of the primary suction valve 41 is approximately the same as that of the deforming section 421 of the auxiliary suction valve 42, however, the length of the deforming section 411 is shorter than the length of the deforming section 421. The pressure given to the closing section 412 of the primary suction valve 41 from the suction chamber 131 side at the start of a suction stroke is the same as that given to the closing section 422 of the auxiliary suction valve 42 from the suction chamber 131 side. However, since the length of the deforming section 411 is different from the length of the deforming section 421, the opening performance of the auxiliary suction valve 42 is higher than that of the primary suction valve 41. Therefore, when a rate of flow of the refrigerant is low, only the auxiliary suction port 22 is opened. When the widths of the deforming sections 411, 421, which are the pushing means, are the same, a difference in the length between the deforming sections 411 and 421 determines a difference in the pushing force. When the opening performance is appropriately set, the lengths of the deforming sections 411, 421 are factors capable of being simply adjusted.

Figure 6:
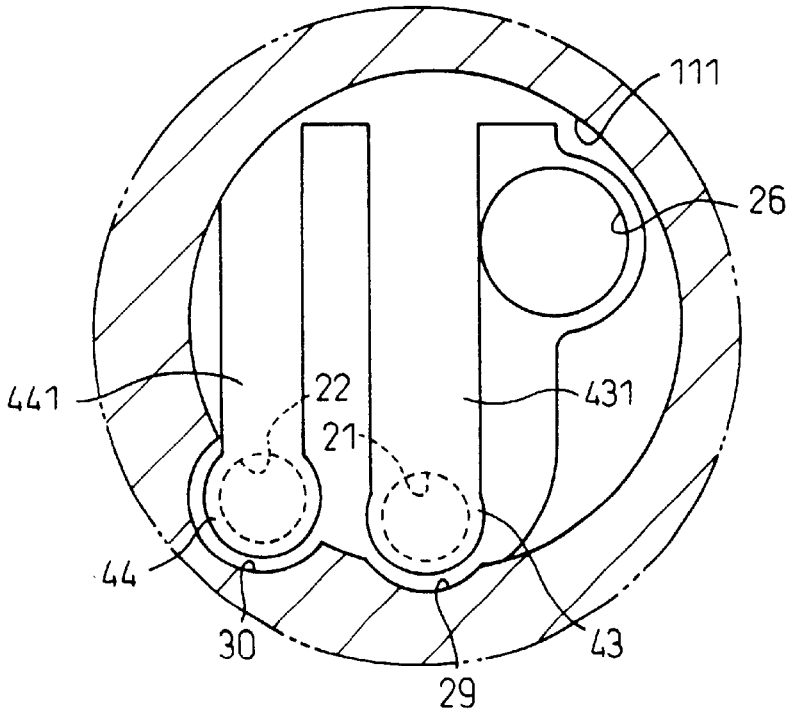
FIG. 6 is an enlarged cross-sectional view showing a primary portion of the third embodiment of the present invention.

In the third embodiment shown in FIG. 6, the diameter of the primary suction port 21 and that of the auxiliary suction port 22 are the same. Therefore, the cross-sectional area of the primary suction port 21 and that of the auxiliary suction port 22 are the same. The length of the deforming section 431 of the primary suction valve 43 is approximately the same as that of the deforming section 441 of the auxiliary suction valve 44, however, the width of the deforming section 431 is longer than the width of the deforming section 441. The pressure given to the closing section of the primary suction valve 43 from the suction chamber 131 side at the start of a suction stroke is the same as that given to the closing section of the auxiliary suction valve 44 from the suction chamber 131 side. However, since the width of the deforming section 431 is different from the width of the deforming section 441, the opening performance of the auxiliary suction valve 44 is higher than that of the primary suction valve 43. Therefore, when a rate of flow of the refrigerant is low, only the auxiliary suction port 22 is opened. When the lengths of the deforming sections 431, 441, which are the pushing means, are the same, a difference in the width between the deforming sections 431 and 441 determines a difference in the pushing force. When the opening performance is appropriately set, the widths of the deforming sections 431, 441 are factors capable of being simply adjusted.

Figure 7:
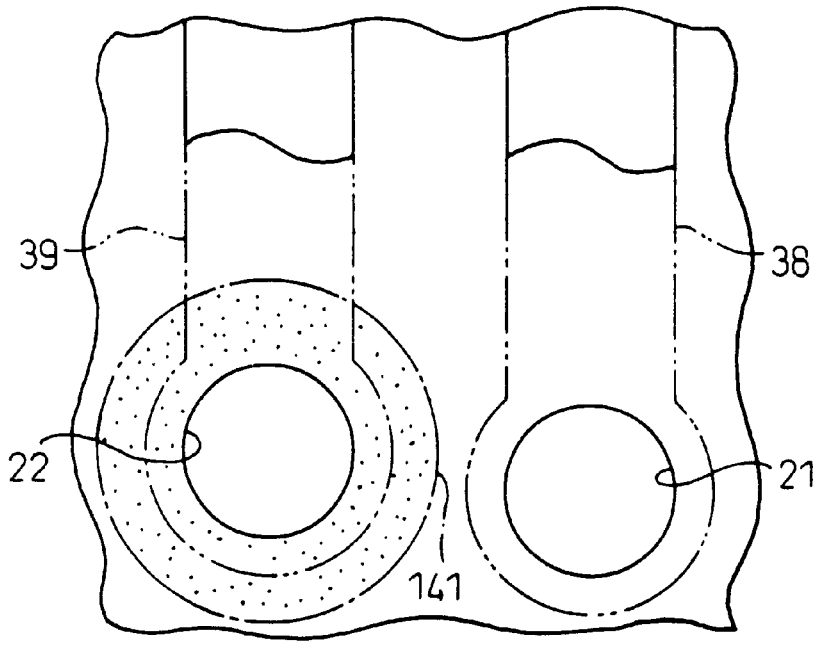
FIG. 7 is an enlarged cross-sectional view showing a primary portion of the fourth embodiment of the present invention.

In the fourth embodiment shown in FIG. 7, a joining face 141 on the partition plate 14 for the auxiliary suction valve 39 is formed into a rough face. Lubricant flowing together with refrigerant gas lubricates portions in which lubrication is required. When the primary suction valve 38 closes the primary suction port 21 and the auxiliary suction valve 39 closes the auxiliary suction port 22, the primary suction valve 38 and the auxiliary suction valve 39 adhere closely to the partition plate 14 due to the lubricant. An intensity of the adhering force between the auxiliary suction valve 39 and the rough face 141 is lower than that between the primary suction valve 38 and the smooth face. Therefore, the opening performance of the auxiliary suction valve 39 is higher than that of the primary suction valve 38. The surface roughness of the joining face on the partition plate 14 for the primary suction valve 38 and the auxiliary suction valve 39 is the opening performance restricting means, that is, the higher the surface roughness on the joining face is, the higher the opening performance is enhanced. In order to appropriately set the opening performance, the surface roughness on the joining face is a factor capable of being easily adjusted.

Figure 8:
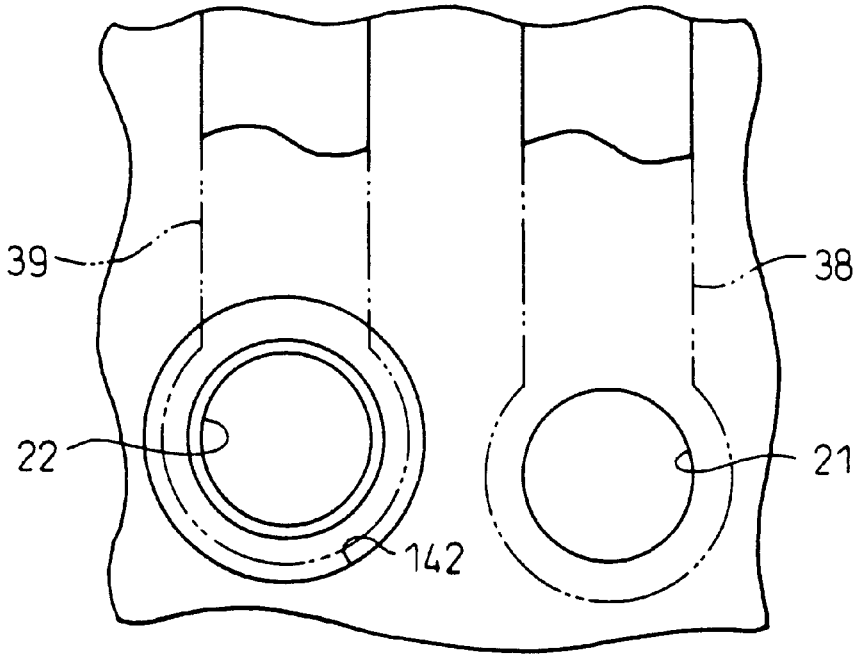
FIG. 8 is an enlarged cross-sectional view showing a primary portion of the fifth embodiment of the present invention.

In the fifth embodiment shown in FIG. 8, an annular groove 142, the profile of which is circular, is formed round the auxiliary suction port 22. A circumferential edge portion of the closing section 392 of the auxiliary suction valve 39 protrudes onto the annular groove 142. A joining area of the closing section 392 with respect to the partition plate 14 differs by the presence of the annular groove 142 or the profile of the annular groove 142. An adhering force between the auxiliary suction valve 39 and the partition plate 14 is lower than that between the primary suction valve 38 and the partition plate 14. Therefore, the opening performance of the auxiliary suction valve 39 is higher than that of the primary suction valve 38. The annular groove 142 becomes an opening performance restricting means, that is, the larger the overlapping area between the annular groove 142 and the auxiliary suction valve 39 is, the higher the opening performance is enhanced.

In order to appropriately set the opening performance, the annular groove 142 is a factor capable of being simply adjusted.

Figure 9:
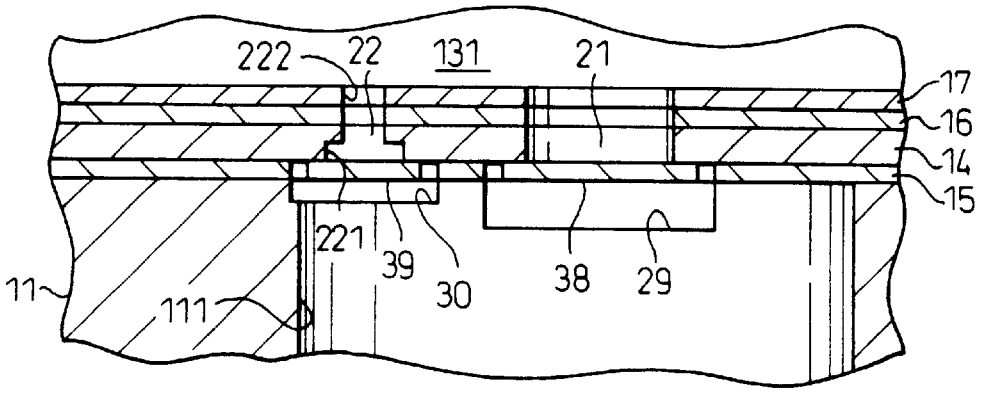
FIG. 9 is an enlarged cross-sectional view showing a primary portion of the sixth embodiment of the present invention

In the sixth embodiment shown in FIG. 9, a diameter of the opening 221 of the auxiliary suction port 22 on the cylinder bore 111 side is larger than that of the opening 222 on the suction chamber side 131. The larger the diameter of the auxiliary suction port 22 on the cylinder bore 111 side is, the higher the opening performance of the auxiliary suction valve is enhanced. Due to the above structure in which a difference is made between the diameter of the opening 221 and that of the opening 222, the cross-sectional area of the auxiliary suction port 22 suitable for a small capacity can be easily set, and further the opening performance suitable for suppressing vibration of the suction valve can be easily set.

The present invention is not limited the above specific embodiments. It is possible to adopt the following embodiments.

Thickness of the deforming section of the suction valve is made to be an opening performance restricting means. The smaller the thickness of the deforming section is, the higher the opening performance is enhanced. In this case, the primary and the auxiliary suction valve may be formed separately from the valve forming plate.

Alternatively, at least two of the width of the deforming section of the suction valve, the length of the deforming section, the thickness of the deforming section and the cross-sectional area of the suction port may be adjusted so as to set the opening performance.

Further, suction valves, the number of which is not less than three, may be made to correspond to one cylinder bore.

Furthermore, the opening performance of at least one of the plurality of suction valves corresponding to one cylinder bore may be enhanced more than the opening performance of at least one of other suction valves.

Furthermore, the sixth embodiment may be applied to the primary suction valve 38.

Furthermore, the present invention can be applied to a constant capacity type piston type compressor.

As described above in detail, according to the present invention, the opening and closing motions of a plurality of suction valves corresponding to one cylinder bore are made independent from each other, and the opening performance of at least one of the plurality of suction valves is enhanced more than the opening performance of at least one of other suction valves. Therefore, the present invention can provide an excellent effect that the generation of abnormal sounds caused by vibration of the suction valves of a piston type compressor can be effectively prevented.

While the invention has been described by reference to specific embodiments chosen for purposes of illustration, it should be apparent that numerous modification could be made thereto by those skilled in the art without departing from the basic concept and scope of the invention.

What is claimed is:

1. A structure of a suction valve of a piston type compressor in which a suction port for sucking refrigerant gas is opened and closed by the suction valve, and refrigerant gas is sucked into a cylinder bore by the suction valve which is pulled apart from the suction port by a sucking motion of a piston arranged in a cylinder bore, the structure of the suction valve comprising:

a plurality of suction ports corresponding to one cylinder bore;

a plurality of suction valves corresponding to each suction port, respectively;

a plurality of maximum opening degree restricting means for restricting the maximum opening degree of each suction valve when the maximum opening degree restricting means comes into contact with each suction valve, corresponding to each suction valve, respectively; and a plurality of opening performance restricting means for restricting the opening performance of the suction valves to open the suction ports, corresponding to each suction port, respectively, wherein the opening and closing motions of the plurality of suction valves are made independent from each other, and the opening performance of at least one of the plurality of suction valves is enhanced more than the opening performance of at least one of the other suction valves.

2. A structure of a suction valve of a piston type compressor according to claim 1, wherein the opening performance restricting means is means for pushing the suction valve in the direction of closing the suction port.

3. A structure of a suction valve of a piston type compressor according to claim 2, wherein the suction valve is a flexible deforming valve including a deforming section, which is supported by a cantilever method, and a closing section for closing the suction port being connected with a forward end portion of the deforming section, and the pushing means is the deforming section.

4. A structure of a suction valve of a piston type compressor according to claim 3, wherein the thicknesses of the deforming sections of the plurality of flexible deforming valves are the same, and the opening performance of the deforming sections is made to differ when the widths of the deforming sections are made to differ.

5. A structure of a suction valve of a piston type compressor according to claim 3, wherein the thicknesses of the deforming sections of the plurality of flexible deforming valves are the same, the opening performance of the deforming sections is made to differ when the lengths of the deforming sections are made to differ.

6. A structure of a suction valve of a piston type compressor according to claim 1, wherein a plurality of pistons are arranged round a rotating shaft, the plurality of pistons are reciprocated in the cylinder bores when the rotating shaft is rotated, the suction ports are formed on a partition plate for partitioning the suction chamber, the discharge chamber and the cylinder bore, the discharge chamber is formed so that it can surround the suction chamber, refrigerant gas is sucked from the suction chamber into the cylinder bore via the suction port, and the refrigerant gas is discharged from the cylinder bore into the discharge chamber via the discharge port formed on the partition plate.

7. A structure of a suction valve of a piston type compressor according to claim 6, wherein the suction valve is a flexible deforming valve, and the suction valve extends in the radial direction of the rotating shaft and in the axial direction of the rotating shaft in such a manner that it cross the cylinder bore.

8. A structure of a suction valve of a piston type compressor in which a suction port for sucking refrigerant gas is opened and closed by the suction valve, and refrigerant gas is sucked into a cylinder bore by the suction valve which is pulled apart from the suction port by a sucking motion of a piston arranged in a cylinder bore, the structure of the suction valve comprising:

a plurality of suction ports corresponding to one cylinder bore;

a plurality of suctions valves corresponding to each suction port, respectively;

a plurality of maximum opening degree restricting means for restricting the maximum opening degree of each suction valve when the maximum opening degree restricting means comes into contact with each suction valve, corresponding to each suction valve, respectively;

a plurality of opening performance restricting means for restricting the opening performance of the suction valves to open the suction ports, corresponding to each suction port, respectively;

wherein the opening performance restricting means is an area of the cross section of each suction port; and wherein the opening and closing motions of the plurality of suction valves are made independent from each other, and the opening performance of at least one of the plurality of suction valves is enhanced more than the opening performance of at least one of the other suction valves.

* * * * *

UNITED STATES PATENT AND TRADEMARK OFFICE

CERTIFICATE OF CORRECTION

PATENT NO. : 6,419,467 B1
DATED : December 18, 2001
INVENTOR(S) : Murase et al.

It is certified that error appears in the above-identified patent and that said Letters Patent is hereby corrected as shown below:

Title page,
Item [57], ABSTRACT,
Line 9, delete "supported-and" and insert therefor -- supported and --.

Column 5,
Line 61, delete "suing" and insert therefor -- sucking --.

Signed and Sealed this

Third Day of December, 2002

JAMES E. ROGAN
*Director of the United States Patent and Trademark Office*